US006099208A

United States Patent [19]

McAlister

[11] Patent Number: 6,099,208

[45] Date of Patent: Aug. 8, 2000

[54] ICE COMPOSITE BODIES

[76] Inventor: Padraig McAlister, 3 Island View House, Harbour Road, Howth, County Dublin, Ireland

[21] Appl. No.: 09/101,539

[22] PCT Filed: Jan. 10, 1997

[86] PCT No.: PCT/IE97/00002

§ 371 Date: Jul. 10, 1998

§ 102(e) Date: Jul. 10, 1998

[87] PCT Pub. No.: WO97/25483

PCT Pub. Date: Jul. 17, 1997

[30] Foreign Application Priority Data

Jan. 10, 1996 [IE] Ireland ..... 960011

[51] Int. Cl.[7] ..... E02D 19/14

[52] U.S. Cl. ..... 405/217; 405/195.1

[58] Field of Search ..... 405/217, 130, 405/211, 203, 195.1

[56] References Cited

U.S. PATENT DOCUMENTS

| | | | |
|---|---|---|---|
| 3,738,114 | 6/1973 | Bishop | 405/217 |
| 3,750,412 | 8/1973 | Fitch et al. . | |
| 3,842,607 | 10/1974 | Kelseaux et al. . | |
| 4,055,052 | 10/1977 | Metge . | |
| 4,094,149 | 6/1978 | Thompson et al. . | |
| 4,187,039 | 2/1980 | Jahns et al. | 405/217 |
| 4,242,012 | 12/1980 | Utt . | |
| 4,431,346 | 2/1984 | Husebye | 405/217 |
| 4,432,669 | 2/1984 | Cox et al. | 405/217 |
| 4,632,604 | 12/1986 | McKelvy . | |
| 4,637,217 | 1/1987 | Owen et al. | 405/217 |

FOREIGN PATENT DOCUMENTS

| | | |
|---|---|---|
| 0 009 986 | 4/1980 | European Pat. Off. . |
| 183 536 | 8/1922 | United Kingdom . |
| 2 071 295 | 9/1981 | United Kingdom . |
| 2 185 770 | 7/1987 | United Kingdom . |
| 86 06771 | 11/1986 | WIPO . |

*Primary Examiner*—Eileen Dunn Lillis
*Assistant Examiner*—Frederick Lagman
*Attorney, Agent, or Firm*—Fulbright & Jaworski, LLP

[57] ABSTRACT

An ice composite body has an inner ice core covered by a protective outer armor layer. Thermal insulation is provided between the inner core and the outer armor layer. Refrigeration is accomplished by a system of conduits for refrigerant are located within the body. The insulation and the refrigeration are adapted to maintain the ice core in a frozen condition relative to the ambient temperature. The base of the body cavity can be in direct contact with the water bed such that the ice core is freeze bonded to an advancing ice front in the water bed. The ice composite body provides structures of equal or greater strength than equivalent structures using conventional materials.

27 Claims, 7 Drawing Sheets

ICE COMPOSITE BODIES

TECHNICAL FIELD

This invention relates to ice composite bodies for use in the construction of fixed or floating structures located in or on water.

BACKGROUND ART

U.S. Pat. No. 4,456,072 discloses a fixed structure for location over a submerged drill site in waters which normally freeze in winter. The structure comprises generally concentric vertically oriented cylindrical inner and outer walls which define an annular space therebetween. This space is filled with ice, and when completed, the walls extend down to the seabed and the intervening space is filled with ice. The area inside the inner wall thus defines an enclosed volume of water which can be prevented from freezing relatively easily, such as by spreading a layer of insulating material on the surface of the water, and within this area operations such as drilling for offshore oil can proceed throughout the winter.

A disadvantage with this structure is that although it provides an artificial island, its use is limited to waters which normally freeze in winter. Thus its use is confined to a limited geographical area and to a seasonal period only. While this is adequate for the purposes for which it is intended (maintaining a drilling site in winter), and while the geographical and seasonal limitations of this technology are not drawbacks in the application in question (since the structure is only required during that season and in that region), the structures disclosed in U.S. Pat. No. 4,456,072 are of limited application.

A further limitation with the structures of U.S. Pat. No. 4,456,072 is that they require fixing to the seabed and cannot be used in locations where the water is relatively deep.

Suggestions have been made for transporting ice to more temperate climates, such as towing large ice floes to drought affected areas, on the assumption that melting losses during the journey will not be too great. Such suggestions have not been put into practice, and they highlight the perceived reasons for the limited use of ice outside arctic or antarctic regions, namely that refrigeration costs are thought to be prohibitive in any large-scale or long-term use of ice.

While there have undoubtedly been other proposals for and uses of ice in structural applications, the general problem with these structures is that their use is subject to geographical and/or seasonal limitations.

It is an object of this invention to provide an ice composite body in which the above cited disadvantages are reduced or eliminated, the potential structural applications of ice composite bodies realised and particularly the ability realised to make dimensionally stable ice composite structures of any desired shape and design.

DISCLOSURE OF INVENTION

According to the present invention there is provided an ice composite body for use in the construction of fixed or floating structures located in or on water, said body comprising an inner ice core, a protective outer armour layer, means for thermally insulating the ice core and refrigeration means comprising a system of conduits for refrigerant within the body, said insulating means and refrigeration means being adapted, relative to the ambient temperature of the surrounding water, to maintain the ice core in a frozen condition.

It has been found that this construction allows the use of ice composite bodies in waters which have temperatures significantly above freezing point. Based on this construction, ice composite bodies according to the invention can be used in the construction of large-scale structural projects for a fraction of the cost of building the same structure using conventional materials.

Examples of the type of structures in question are bridges, breakwaters, causeways, pontoons, artificial islands, dams, tidal barrages, wave power barrages, harbour walls, wind power farms or aircraft runways. These applications are given by way of example only.

When the ice composite body according to the invention is for use in the construction of fixed or floating structures located in or on fresh water, preferably the ice core is maintained at a temperature of less than 0° C. less a further 0.5° C. for each 50 atmospheres of pressure experienced by the ice at its most stressed point said pressure including pressure shock waves experienced in normal use.

This temperature limitation prevents the body being weakened by partial melting or localised melting due to internal pressure and/or pressure fronts resulting from shock waves travelling through the body. While it might appear to be preferable to strengthen the body by having the lowest ice core temperature possible, this may be uneconomical as refrigeration costs increase with lower temperatures. By maintaining the core at or slightly below the temperature set out above, the optimum strength can be achieved for minimal refrigeration costs.

As an example, if the body is to be used as the basis for a floating runway, the internal or lithostatic pressure arising from the weight of the ice itself, the hydrostatic pressure from the surrounding water, and the maximum pressure resulting from the shock waves of a forced landing of an aircraft would all be taken into account when calculating the ice core temperature using the above formula.

Similarly, when the body according to the invention is for use in the construction of fixed or floating structures located in or on salt water, preferably the ice core is maintained at a temperature of less than −2.2° C. less a further 0.5° C. for each 50 atmospheres of pressure experienced by the ice at its most stressed point, said pressure including pressure shock waves experienced in normal use.

This temperature limitation takes into account the lower freezing point of salt water. If other additives are included in the ice which vary the melting point, the figure of 0° C. or −2.2° C. in the above formulae are replaced by the corresponding freezing point of the ice including such additives.

In certain embodiments, the insulating means is part of the armour layer, the degree of insulation being determined by the thickness of said armour layer and the nature of the material used for said armour layer.

In other embodiments, the insulating means comprises a layer of insulating material situated intermediate the ice core and the armour layer.

Whether the insulating means is part of the armour layer or is a separate layer is determined according to the requirements such as safety, strength, local average temperature and lifetime cost, with the choice being made by the designer of the structure, using the normal design criterion of meeting all safety and regulatory requirements at minimum lifetime cost.

Preferably, the insulating means and the refrigeration means are adapted to maintain the ice core in a frozen condition at ambient water temperatures of greater than 5° C., more preferably 10° C. or 15° C.

According to the invention, the ice core can be maintained in waters at any temperature above 0° C., and there is no technical upper limit to the water temperatures in which the invention can be used.

Because the armour layer, insulating layer and refrigeration means allow the ice core to remain frozen at elevated ambient water temperatures, the invention can be used at temperatures of 5° C., 10° C., 15° C. or higher, whereas previous known ice composite bodies are suitable only for use in cold environments.

Suitably, the conduits are confined to the armour layer and insulating layer, if present.

Alternatively, the conduits extend into the ice core.

When the conduits extend into the ice core, they can provide reinforcement for the structure, and also they can maintain the required temperature more easily throughout the ice core.

For a body according to the invention which is for use in the construction of fixed structures located in water, preferably the armour layer is provided on the top and sides of the ice core, and the ice core is frozen onto the water bed.

This provides the advantage that the structure is solidly structurally fixed to the water bed by the freeze bond between the ice core and the water bed. A watertight seal is created which is particularly important in cases where the passage of water in any direction is to be restricted by the structure. For example, if the structure contains a hollow shaft for access to the water bed internally of the core, a watertight seal allows an easy means of achieving a dry internal shaft in which people can work or equipment can be used. Another example is if the structure is part of a dam or a tidal power station, in which case water can be prevented from crossing the structure.

In prior art dams or tidal power stations made of conventional materials, a watertight seal at the base is technically very difficult to achieve, since foundations must be laid. Even if a watertight seal is not required, the solid fixing of a conventional structure is difficult and expensive because of the necessity of driving piles into the water bed to secure the structure.

For a body according to the invention which is for use in the construction of fixed structures located in water suitably the sides are angled to provide a tapered structure which is wider at the base than at the top, said angled sides serving to reduce the stresses arising from increasing hydrostatic and lithostatic pressures which arise with increasing depth.

By "lithostatic pressure" herein is meant die pressure per unit plan area in a solid due to the weight of solid or liquid material resting on that area, analogous to the hydrostatic pressure on a unit area in a fluid.

If the stresses are reduced by angling the sides, a stable, strong structure can be achieved using the minimum amounts of materials.

Further, preferably, the sides are angled at an angle θ from the vertical. θ being defined by the formula:

$$H_C\ t_C\ D_C \tan\theta = F_i - F_w,$$

wherein:

$H_C$ is the height of the highest point of the armour layer above the water bed;

$t_C$ is the thickness of the armour layer and insulating layer, if present;

$D_C$ is the average density of the armour layer and insulating layer, if present;

$F_i$ is the average force per unit length applied to the armour layer and insulating layer, if present, by the lithostatic pressure of the ice; and $F_w$ is the average force per unit length applied to the armour layer and insulating layer, if present, by the hydrostatic pressure of the surrounding water.

Alternatively, if the sides are angled at an angle θ from the vertical, and the expression:

$$F_i - F_w - (H_C\ t_C\ D_C \tan\theta)$$

is positive, the terms $F_i$, $F_w$, $H_C$, $t_C$ and $D_C$ being defined as above, the body preferably further comprises a tensioning member connecting the armour layer on opposite sides of the body to counteract any net spreading force.

As a further alternative, if the sides are angled at an angle θ from the vertical, and the expression:

$$F_i - F_w - (H_C\ t_C\ D_C \tan\theta)$$

is negative, the terms $F_i$, $F_w$, $H_C$, $t_C$ and $D_C$ being defined as above, the body preferably further comprises a compression member connecting the armour layer on opposite sides of the body to counteract any net compression force.

In a preferred embodiment, the armour layer comprises a number of adjacent armouring side members, said members having differing lengths according to the topography of the water bed, such that the body has a constant height relative to the water level.

In particular for elongated structures on an irregular sea bed, this construction greatly assists in the locating of the structure. An initial mapping of the sea bed would in many cases be necessary in any event before constructing a large-scale structure, and from this any variations in water depth can be compensated for by manufacturing the armouring side members to provide a final structure having a constant height above water.

Preferably when the ice core makes a water-tight seal with the water bed, the portion of the ice core immediately adjacent the water bed is free of armour coating.

In a preferred embodiment, a shaft is provided through the ice core to the water bed, such that work can be can carried out at the water bed in dry conditions at atmospheric pressure.

Suitably, the shaft has a sufficiently large diameter to accommodate humans and any desired equipment at the water bed.

Preferably, for a body according to the invention for use in the construction of floating structures located in or on water, the ice core is totally enclosed in said armour layer.

Further, preferably, the body comprises means for anchoring the body to the water bed.

Preferably, the body has a positive net buoyancy. This ensures that the body floats, which is of assistance if the body is to be moved, as it can be towed by a tug, for example. If a floating body without a positive net buoyancy is required, then flotation aids must be attached.

Preferably, the armour layer comprises a double hull. This is an added safety feature which assists in the event of any damage. For example if the outer hull is punctured, the integrity of the body is maintained, and the ice core will not melt because of contact between the core and the surrounding water.

Preferably, the material used in the armour layer is selected from metal, stone, concrete, reinforced concrete, bitumen macadam, tile, and brick.

Preferably, the insulating material is selected from air, ice, trapped water, stone, earth, concrete, reinforced concrete, insulating cement, plastic foam, wood, wood dust, waste paper, sand, treated urban waste, textile fibre and mineral fibre.

Suitably, the refrigerant conduits are pre-formed integrally in the armour layer or insulating layer, if present.

Alternatively, the refrigerant conduits are formed separately from the armour layer and insulating layer, if present.

In one embodiment, the refrigerant conduits act as internal strengthening members for the body.

Preferably, the ice core is formed from water which has been deionised and/or degassed before freezing. This helps to ensure that the ice is of a high purity and that imperfections or faults are not formed in the ice which might tend to weaken the body.

Suitably, the ice core is formed from water to which an additive has been added before or during freezing, said additive being effective to vary the density of the ice when formed.

Further, suitably, the ice core is formed from water to which an additive has been added before or during freezing, said additive being effective to increase the strength of the ice when formed.

Preferably, the additive is selected from gelatin, long chain hydrocarbons in which any substitutions are primarily hydroxyl groups and long chain polyelectrolytes having hydrogen or hydroxyl binding radicals.

Alternatively, the additive may be selected from metal fibre, ceramic fibre, glass fibre, mineral fibre, plastic or polymer fibre, carbon fibre, peat fibre, wood fibre, concrete, sand, gravel, concrete, stone, plastic foam particles, wood shavings, sawdust and concrete.

Preferably, the additive is added to the water before or during freezing.

As a body of water freezes it typically passes through a slushy stage, i.e. before it is fully frozen and while it still retains many characteristics of a liquid. Advantageously the or each additive can be added to the water at this point in order to ensure a good distribution of the additive through the water when it solidifies. This may be important if the additive is in the form of particulate matter which would normally sink or float in water.

In many cases, the additive will only be added to limited regions of the ice core. For example, wood pulp may be added to strengthen the ice in the region of a tensioning member or compression member. The additive may also be used to influence the thermal conductivity of the ice in limited regions of the core.

As described below, the armour layer may be formed from modular sections and ice is used as a structural material to hold said sections together.

The invention also encompasses a hull of armour layer material for use in the construction of an ice composite body according to the invention.

Suitably, the hull further comprises an insulating layer on the interior of the armour layer.

Preferably, the hull further comprises refrigerant conduits.

A hull according to the invention can be constructed in one location (optionally with an insulating layer and/or refrigerant conduits), and be filled with water at another location before freezing. This has the advantage of reducing transport costs.

In another aspect, the invention encompasses a process of constructing an ice composite body according to the invention, comprising the steps of constructing a hull of armour coating using a technique of slip forming or continuously replaced shuttering.

In a further aspect, the invention encompasses a process of constructing an ice composite body according to the invention, comprising the steps of constructing a hull comprising armour coating, refrigerant conduits and optionally an insulating layer, filling said hull in an inverted position with water, freezing said water, and inverting the thus formed composite body at the site at which it is to be located.

In a further aspect, the invention encompasses a process of constructing an ice composite body according to the invention for use in environments where average ambient temperatures are greater than the freezing point of water, comprising the step of freezing said ice core at a location where average ambient temperatures are less than the freezing point of water, and subsequently transporting the ice composite body to the environment in which it is to be used.

Thus, if the hull floats when filled or partially filled with ice, it can be towed from a cold location (where freezing costs are lower) to a warmer location for use. If the hull does not float it can be towed using flotation aids attached thereto.

In addition, the invention encompasses a process of securing an ice composite body to a water bed, comprising the steps of lowering the body into contact with the bed, the body having a lower surface on which the ice is exposed, and refrigerating the ice sufficiently to cause the lower surface to bond to the water bed.

Preferably in this process, the body is lowered onto a porous water bed, and the refrigeration causes water trapped in the water bed directly below the body to be frozen and thereby bonded to the lower surface.

In yet a further aspect, the invention encompasses a process of constructing an ice composite body according to the invention, comprising the steps of deionizing and/or degassing water, cooling said water in order to freeze it, and adding an additive as defined above to the water before freezing.

The invention further encompasses a fixed or floating structure for location in or on water, comprising an ice composite body according to the invention. Typical examples of such structures include but are not limited to a bridge, a breakwater, a causeway, a pontoon, an artificial island, a dam, a tidal barrage, a wave power barrage, a harbour wall, a wind power farm or an aircraft runway.

Preferably, in suitable structures, the top surface of the armour coating is provided with a roadway surface or a railway track.

The invention will be further illustrated by the following description of embodiments thereof, given by way of example only with reference to the accompanying drawings, in which:

MODES FOR CARRYING OUT THE INVENTION

Figure 1:
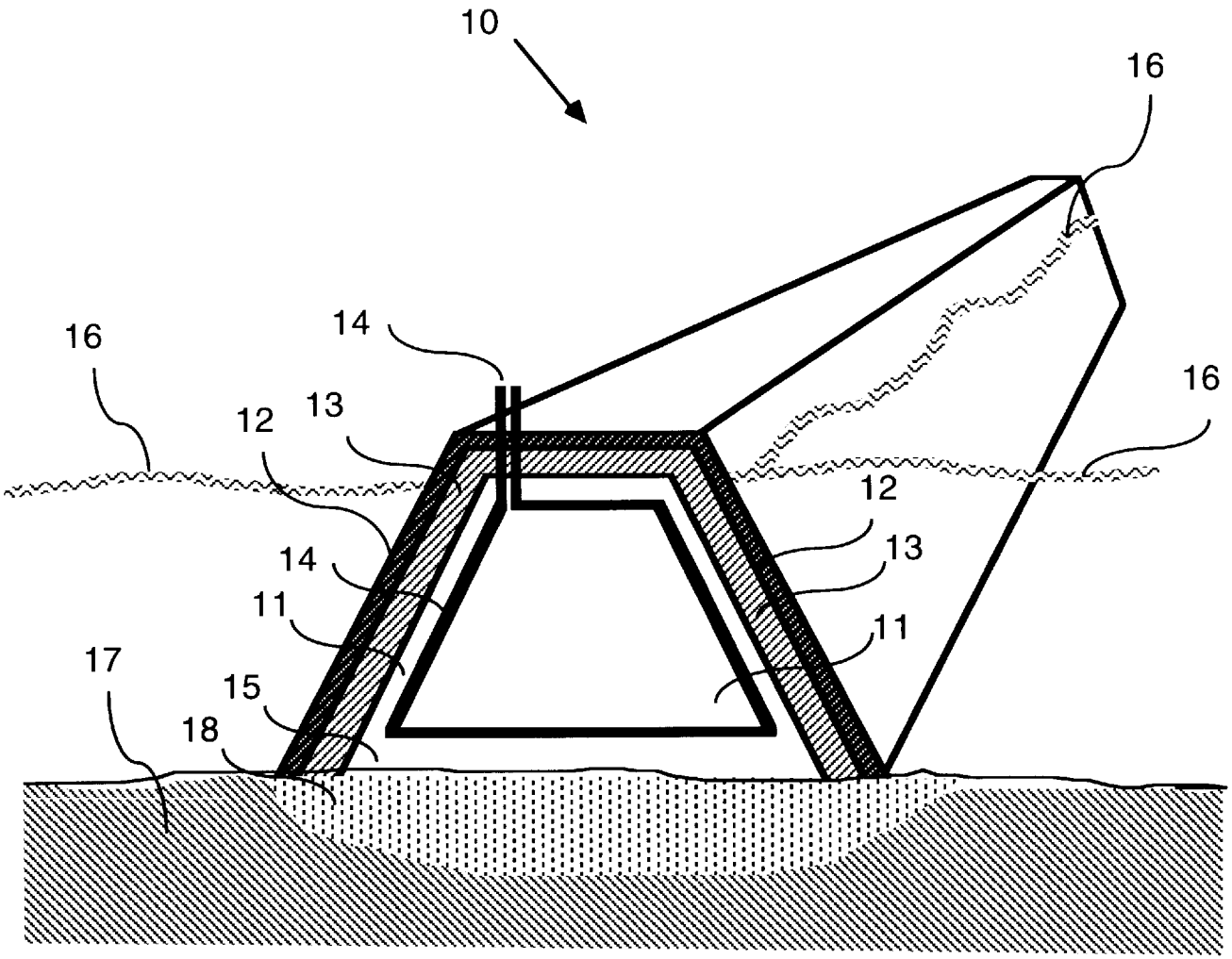
FIG. 1 is a partly cut-away perspective view of a first embodiment of an ice composite body according to the invention fixed to a water bed.

In FIG. 1 there is indicated, generally at 10, an ice composite body according to the invention for use in the construction of fixed structures located in water. The body 10 is shown in perspective with a cut-away showing the cross section thereof. It can be seen that the body 10 has a shape similar to many causeways or harbour breakwaters, and the body 10 is useful as such a structure.

The body 10 comprises an ice core 11, a reinforced concrete armour layer 12, a concrete insulating layer 13, and a system of refrigerant conduits 14 which in use are filled with circulating refrigerant supplied by a refrigerator (not shown).

In this embodiment no insulator or armour is used at the base 15 of the composite body 10. The water surface 16 and the water bed 17 are shown. Below the base the ice core 11 has caused the water bed 17 to freeze, such that an advancing region of frozen water bed 18 (i.e. an advancing ice front) is formed. The frozen region 18 advances into the subsurface to its equilibrium point which is determined by the equating of the geothermal heat flux with the heat flux removed by refrigeration, the former being constant and small and the latter reducing due to the insulating effect of the ice in frozen water bed region 18 as it moves earthwards until the two heat flows equate. This ice front freeze binds the body 10 to the water bed 17 and provides a very strong water tight seal at the base. This embodiment is particularly suitable for fixing structures such as fixed causeways, dams, tidal barrages, wave power barrages, harbour walls, breakwaters and the like, to a waterbed.

Figure 2:
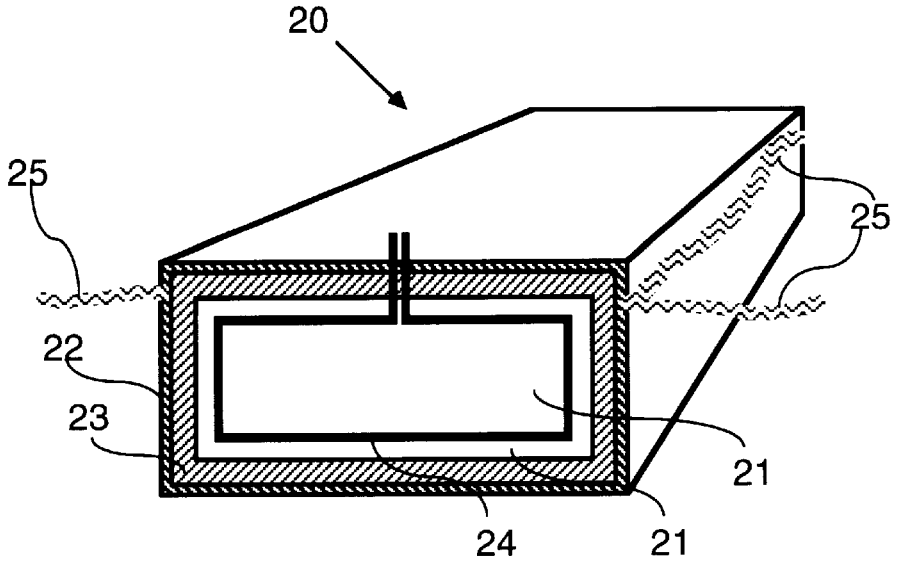
FIG. 2 is a partly cut-away perspective view of a second embodiment of an ice composite body according to the invention floating in water.

FIG. 2 shows a second embodiment of an ice composite body, indicated generally at 20. The body 20 is suitable for floating applications and has a shape similar to many marine vessels, floating breakwaters, pontoons or the like. Body 20 comprises an ice core 21, the armour layer 22, the insulating layer 23, and refrigerant conduits 24. In this embodiment the armour layer 22 and insulating layer 23 extend around the total exterior of the composite body 20. The waterway surface 25 is shown on both sides of the composite. This embodiment is particularly suitable for use as a floating construction which has to be moved regularly from time to time.

Figure 3:
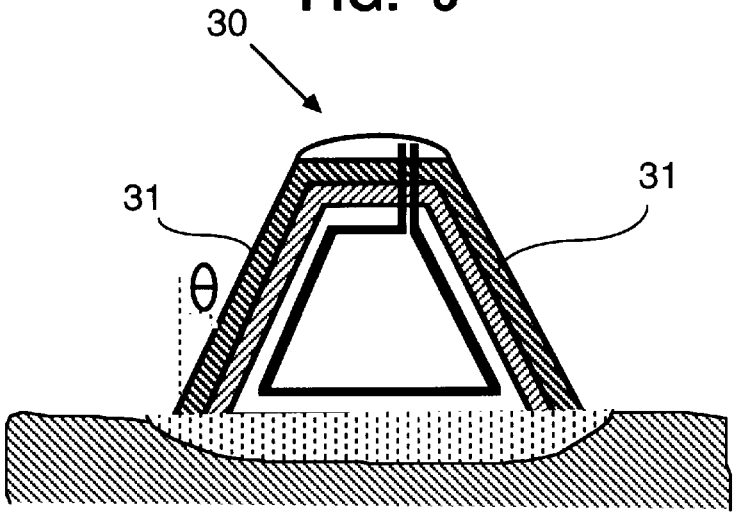
FIG. 3 is a partly cut-away perspective view of a third embodiment of an ice composite body according to the invention fixed to a water bed.

FIG. 3 shows a fixed ice composite body, indicated generally at 30, in the form of a truncated cone, which thickens as the water deepens. This embodiment is particularly suitable for artificial islands fixed to the seabed base.

The sides 31 are angled at an angle θ from the vertical, θ being defined by the formula: $H_C\ t_C\ D_C \tan\theta = F_i - F_w$. The meaning of these terms is as given above. This angle optimises the strength of the body: as the body thickens towards the base it become stronger. This increase in strength accommodates the extra strain resulting from the increasing force resulting from the increasing overturning moments of wind and wave action as depth increases.

Figure 4:
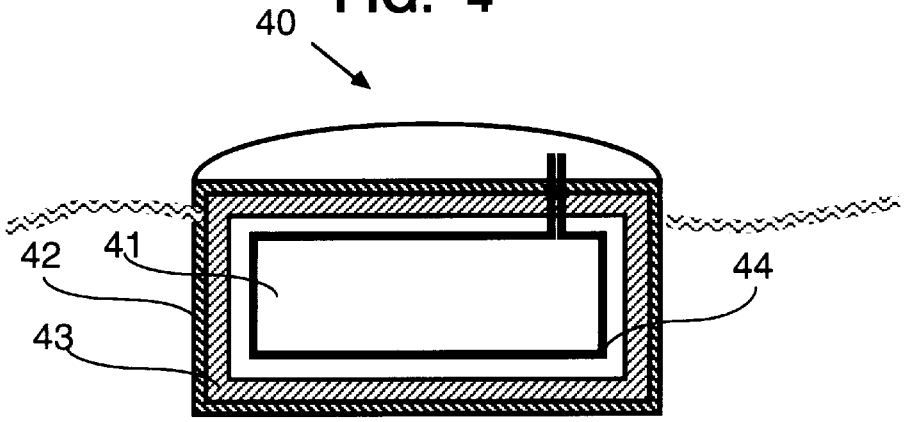
FIG. 4 is a partly cut-away perspective view of a fourth embodiment of an ice composite body according to the invention floating in water.

FIG. 4 shows a circular plan floating composite body 40 similar to that of FIG. 2. Ice core 41, armour layer 42, insulating layer 43 and refrigerant conduits 44 are identified. This embodiment is particularly suitable for use as a floating construction which does not have to be moved frequently.

Figure 5:
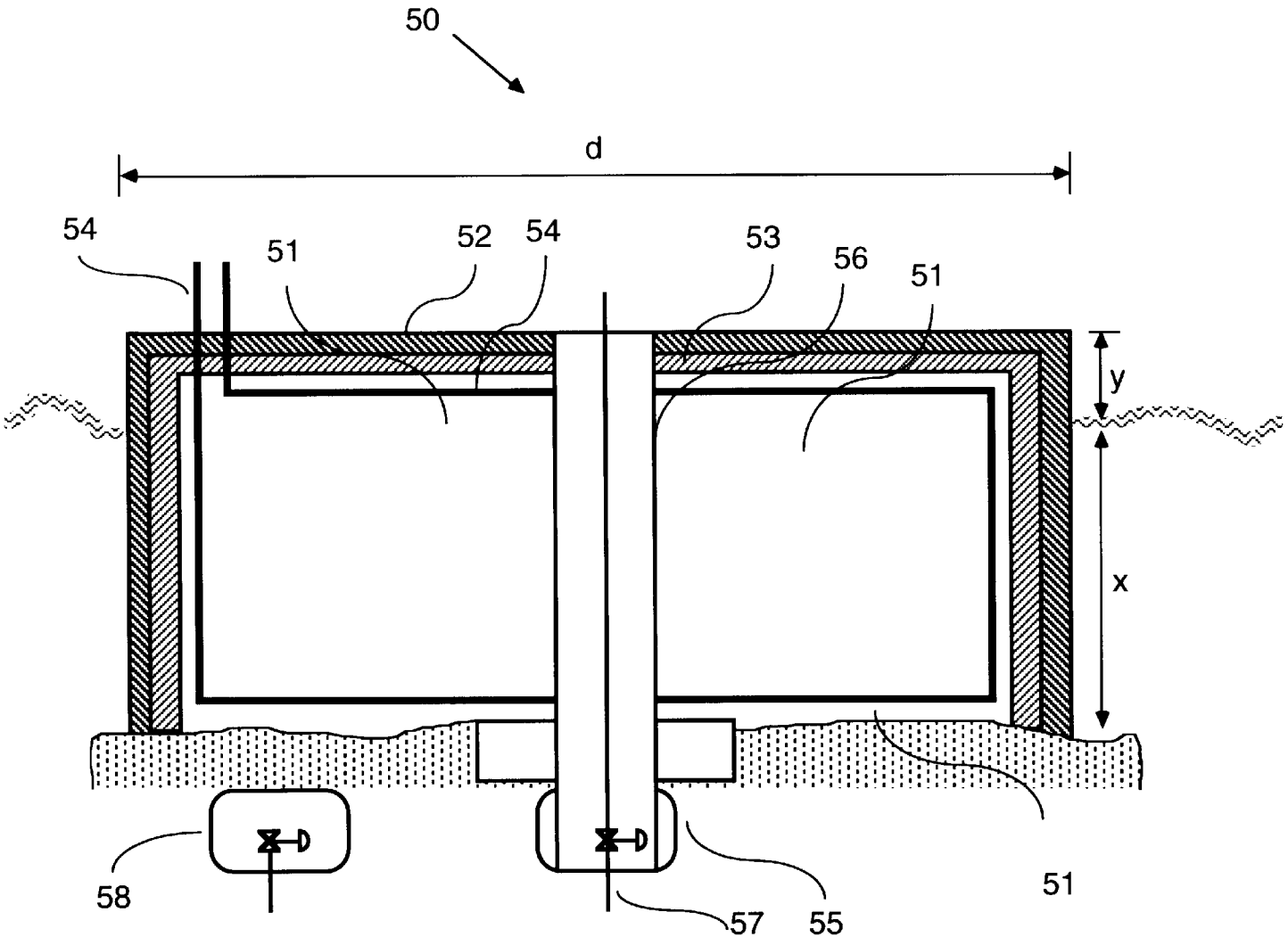
FIG. 5 is a sectional elevation of a fifth embodiment of an ice composite body according to the invention fixed to a water bed.

FIG. 5 shows a particularly advantageous embodiment of an ice composite body, indicated generally at 50, in the form of an artificial island with a circular plan fixed by freeze binding to a seabed base. Body 50 provides an island having an area of approximately 4 hectares in 50 metres of water. Typical dimensions are shown: the diameter (d) is 225 meters, the depth of water (x) is 50 meters and the elevation above the water (y) is 30 meters.

Body 50 comprises an ice core 51, armour layer 52, insulating layer 53 and refrigerant conduits 54. The body 50 is particularly suitable for dry completion of a seabed structure 55 by a dry completion shaft 56. This enables a rising oil production pipe or mineral elevator 57 to be constructed, inspected and maintained directly at the seabed without the use of divers or subsea vehicles. A schematic of an abandoned subsea unit is shown at 58. It is clear from this that this embodiment can be removed at the end of the life of a mineral deposit being exploited and reused elsewhere.

Figure 6:
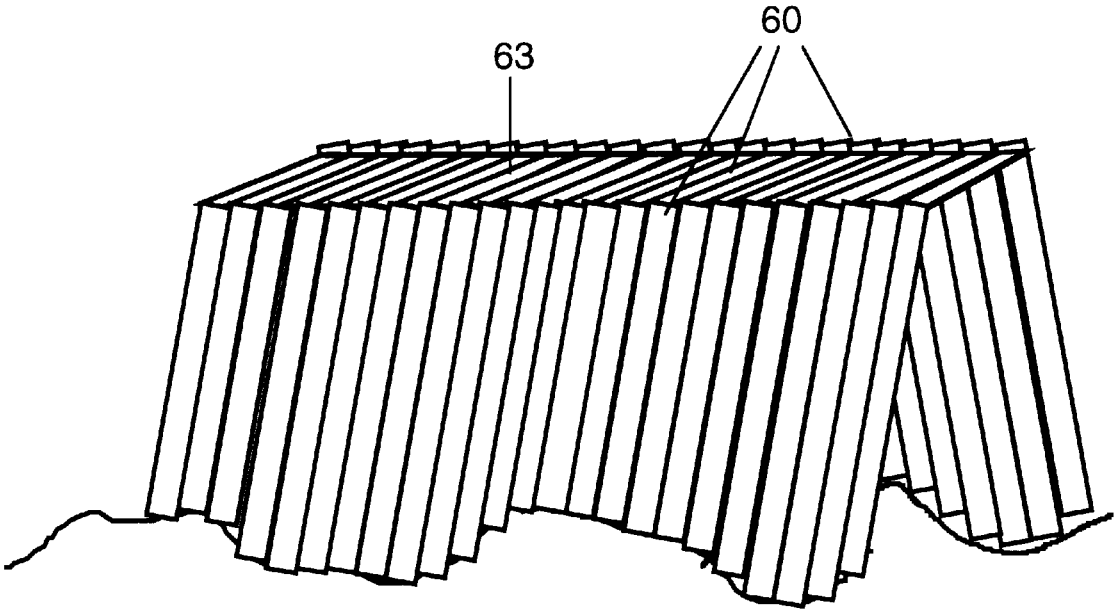
FIG. 6 is a perspective view of armour sections for use in constructing an ice composite body according to the invention fixed to a water bed.
Figure 7:
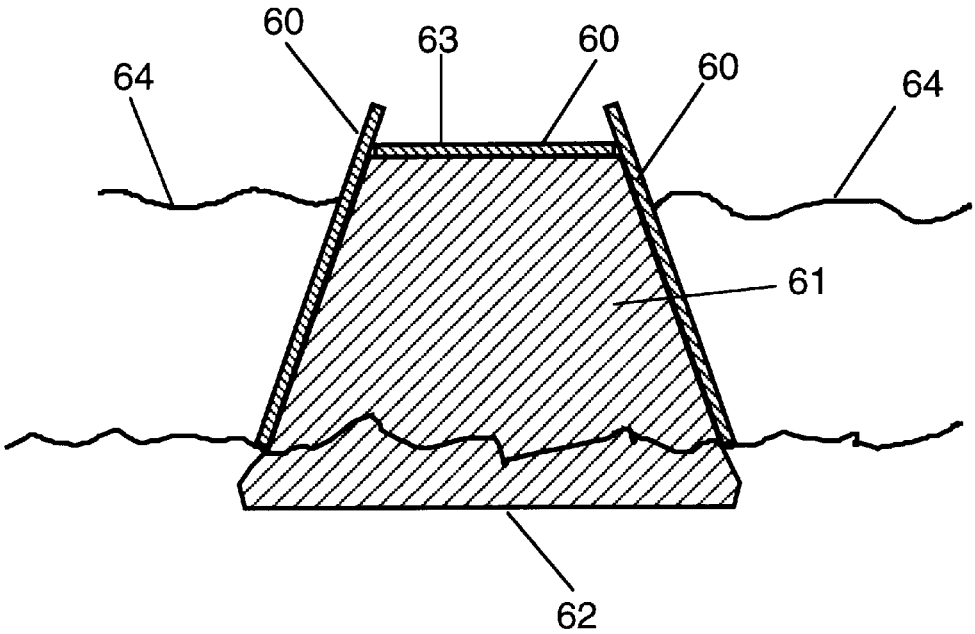
FIG. 7 is a sectional elevation of a sixth embodiment of an ice composite body according to the invention constructed using the armour sections of FIG. 6.

FIGS. 6 and 7 are schematic illustrations of an embodiment utilising modular elements in construction. A plurality of modular construction elements 60 abut against one another, the height of each element being determined by the water depth al the location in which the element is situated. Each element comprises an armour layer overlying an insulating layer, to the interior of which a refrigerant conduit is attached (these components are not shown separately in FIGS. 6 and 7). In FIG. 7 the core ice 61 and the equilibrium ice front 62 in the water bed are illustrated. Because the lengths of individual construction elements are chosen in relation to the water depth (determined by an initial survey), the top surface 63 of the thus formed composite body is at a constant elevation above the water level 64.

Various processes may be used in constructing and affixing the ice composite bodies according to the invention. In one process, the armour and insulator surfaces are constructed as a large shell or in sections using a specially manufactured shuttering. These sections may be separate modules or a single large construction. Following the manufacture of the armour, insulator and refrigeration system at the most suitable location for their manufacture, they are then moved by tug or other suitable method to an ice manufacturing location where refrigeration and the manufacture of the core ice is particularly economical. Cold air at such a location may be usefully used for refrigeration.

Degassed, deionised, treated fresh water is transported to the ice manufacturing location by tanker or alternatively by using the interior of the composite shell as a hull. In this latter case a partial ice fill of the shell may usefully be used as a low cost construction material to attach sections of the shell to each other and to create watertight seals for ease of water transport. At the ice manufacturing location the degassed, deionised, treated fresh water is frozen to form hard freshwater ice with optimum strength properties for the core of the composite. The composite is then moved to its use location for emplacement or positioning and use.

In a similar process, especially suitable for construction in a waterway in a cold climate, the composite body is constructed (which may usefully be in an inverted position) in a series of stages as shown in FIGS. 8–11.

Figure 8:
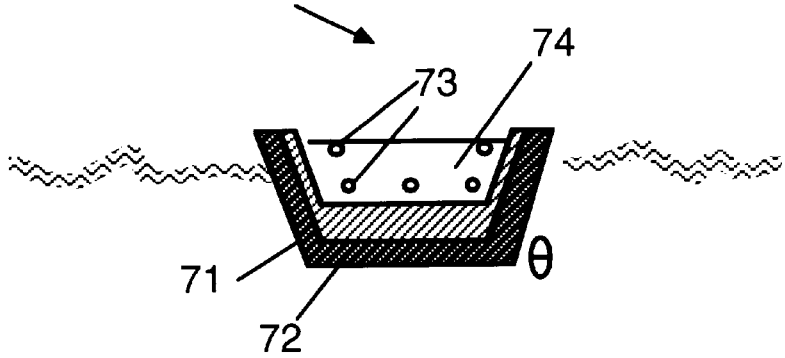
FIGS. 8–11 show successive stages in the construction of an ice composite body according to the invention.

The first step in the construction of an ice composite body 70 is shown in FIG. 8. This first stage consists of the construction of the armour layer 71 in its final shape creating a container like body which floats in the waterway using, if needed, buoyancy aids attached to the exterior. This is then lined with the insulating material 72. Following this the refrigerant conduits 73 are positioned in the container in their final position along what will be the interior of the composite body when the body is in its final position. The container is then filled with a first fill of degassed, deionized fresh water 74, treated as desired with the chosen additives. The water volume is chosen to result in a filling of the first stage volume with ice as the water expands during ice formation.

Figure 9:
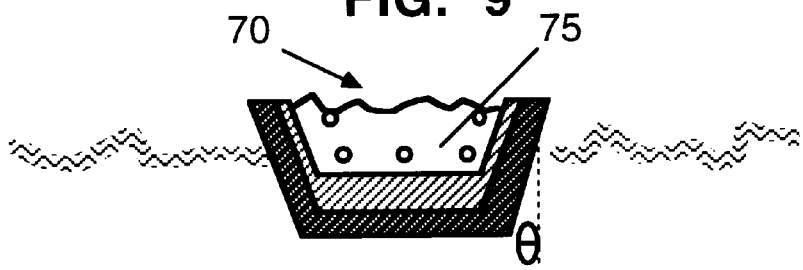

Refrigerant is then pumped through the refrigerant conduits 73 to freeze the water and thereby form the first stage ice core 75 as shown in FIG. 9. During the ice formation process care is taken to prevent the build up of undue stress concentrations by controlling the rate of refrigeration and temperature gradients, particularly between the external and internal parts of the body 70. Stress concentrations are also controlled by a careful choice of the original angle of inclination θ of the side sections of the armour. If a particularly strong construction or variation in density is desired, reinforcing chemicals fibres, stone or metal reinforcement are added to the water during freezing at the slushy stage.

Figure 10:
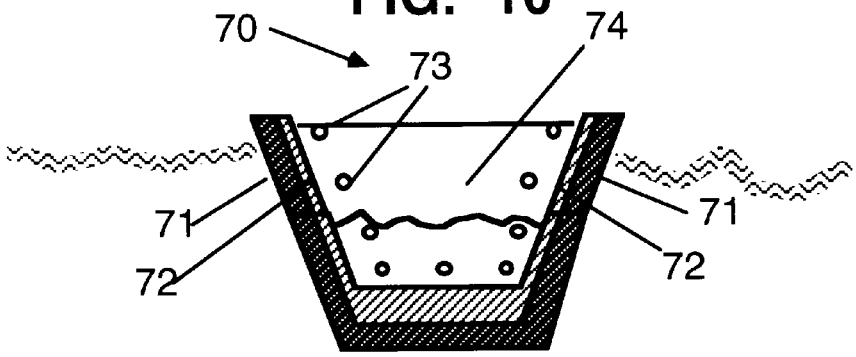
Figure 11:
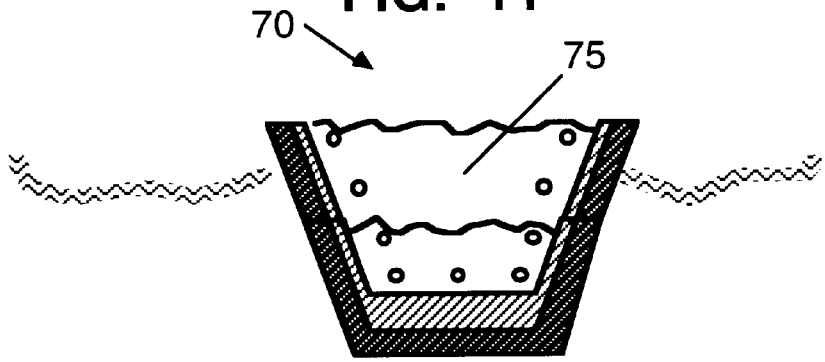

Subsequent stages as shown in FIGS. 10 and 11 consists of building the armour layer 71, insulating layer 72 and conduits 73 by further amounts, adding additional water 74, freezing this second stage water to second stage ice 75, and repeating the process until the total design size required is reached.

For the embodiment shown in FIGS. 8–11, the composite body 70 is inverted to final use orientation. The final stage consists either of closing the composite with an system of refrigerant conduits, an insulation layer and finally an armour layer on the ice core exterior, following which the composite is anchored or dynamically positioned in position, or leaving the base area lacking insulation & armour if it is to be freeze bound in situ and thereby fixed to a waterbed base. This process is especially suitable for constructing a large body from modular elements where construction space on land is limited.

It is clear from this that a composite according to the invention can be conveniently designed to match any base area and following positioning and ballasting of ballast tanks or removal of any buoyancy needed to maintain flotation during manufacture, the composite will settle on to a base area of any shape and configuration, following which the refrigeration system will gradually freeze bind the base of the composite to the waterbed base as shown in FIGS. 1 and 3 until the equilibrium point of the advancing ice front is reached. This process will result in watertight binding of the composite, even to irregularly shaped waterlogged base areas.

The second process of construction to be described consists of constructing the composite in situ in its final use position, using known techniques such as shuttering and similar processes. This is especially suitable for construction on land but may also be carried out on a waterbed. This process can also be carried out in stages by placing the refrigerant conduits in their final position, insulating them with the material chosen, armouring them with the material chosen, isolating the site area for freezing (e.g. by a suitable removable container, shuttering or canopy) to enclose the site and control the composition of the water to be frozen, flushing the original site water with fresh water treating the water as desired, and passing refrigerant through the coils to freeze the water. Subsequent stages are constructed in like manner until the desired size is reached following which the composite is completed with a layer of refrigerant ducts, insulation and armouring, and the container, shuttering or canopy is removed for use elsewhere. This process of construction in situ is especially useful where the waterbed base ground is uneven.

A third process which may usefully be used for composites not subject to significant stresses, for which there are no catastrophic consequences of composite failure and where cost is of the essence, consists of manufacturing the composite from suitable naturally occurring ice by shaping a naturally occurring piece of ice to the desired shape, attaching modular refrigeration, insulation and armour elements to its external surfaces and moving the composite thus made to the desired emplacement location.

Figure 12:
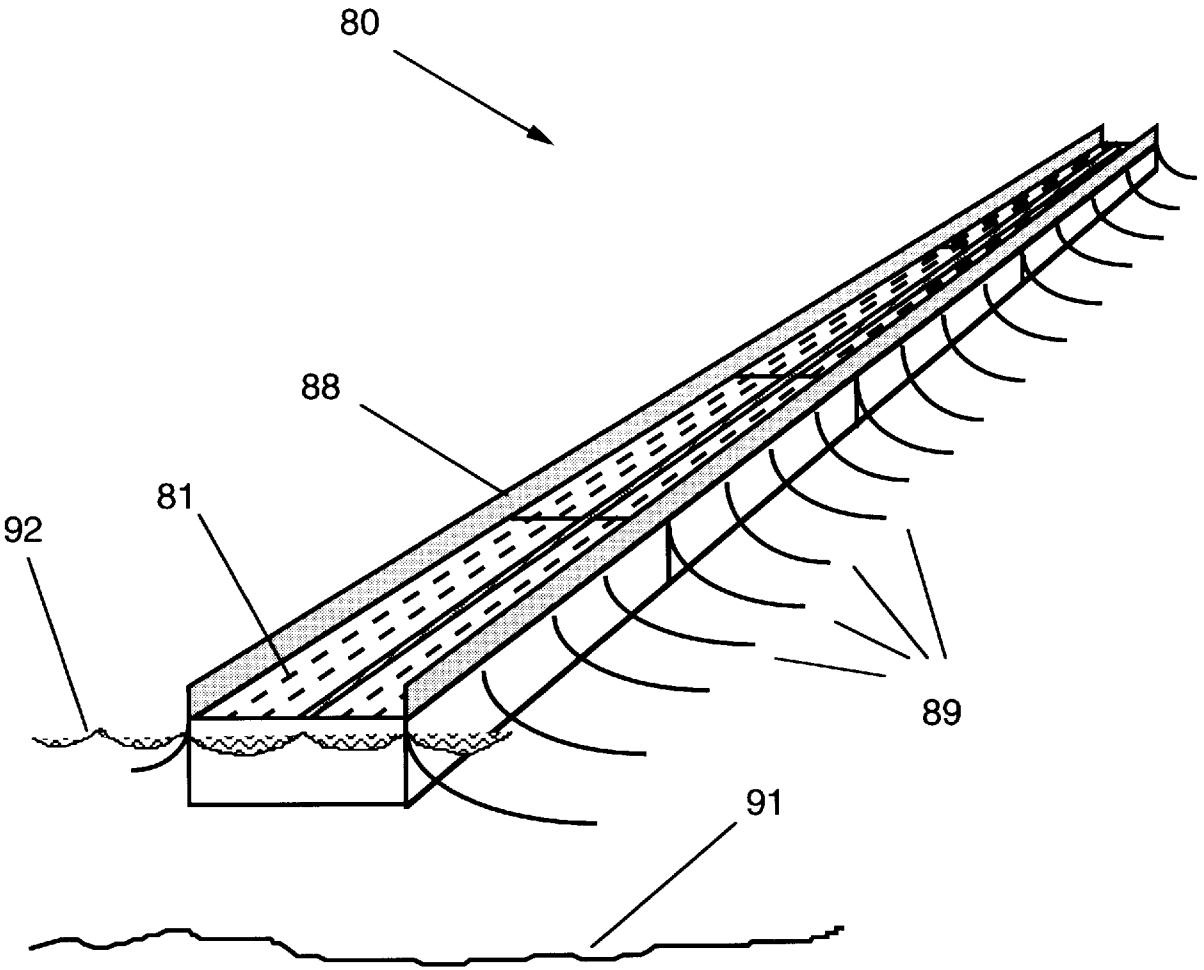
FIG. 12 is a perspective view of a seventh embodiment of an ice to composite body according to the invention in the form of a floating bridge supporting a roadway.
Figure 13:
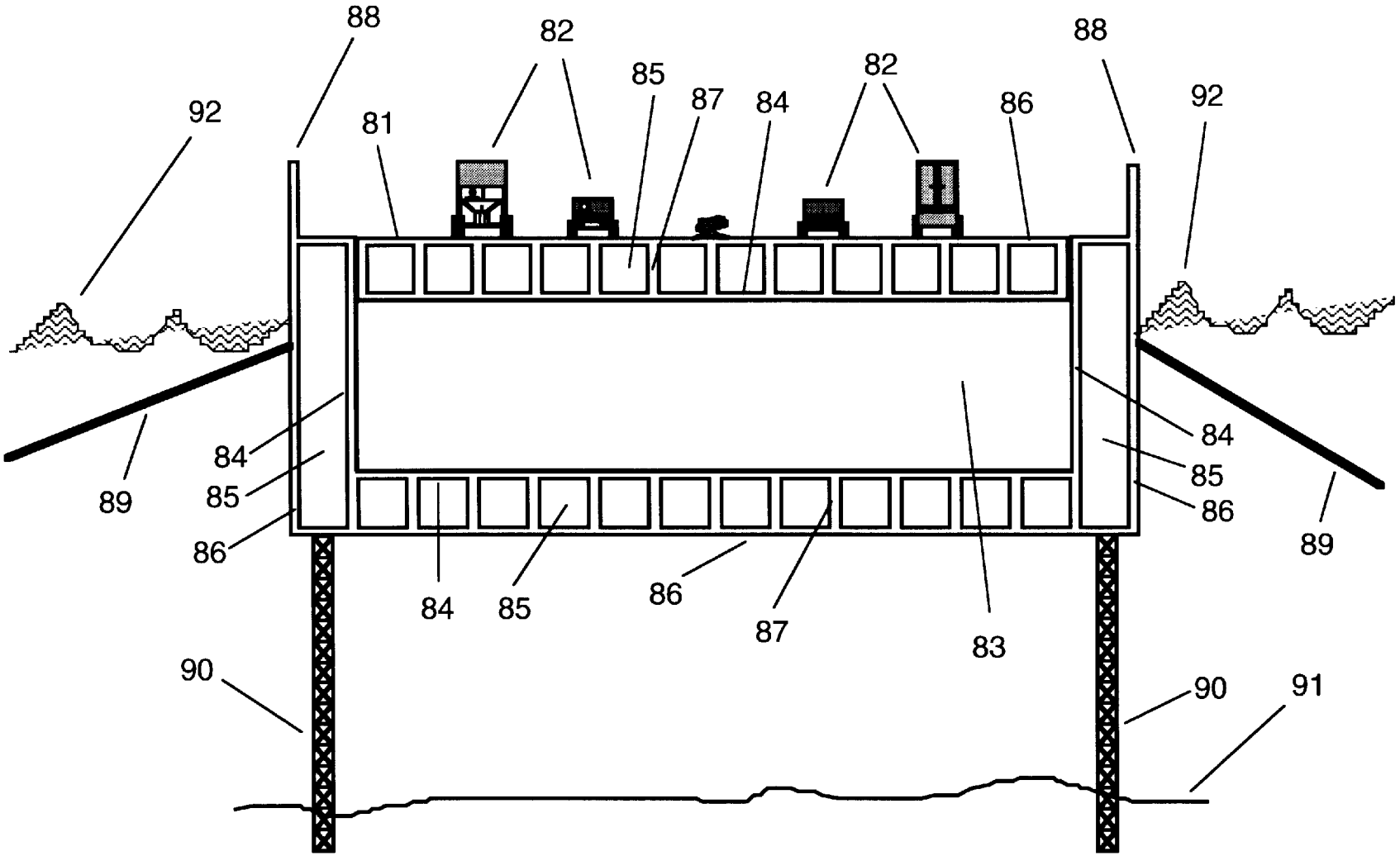
FIG. 13 is a sectional elevation of the embodiment of FIG. 12.

In FIGS. 12 and 13 there is indicated, generally at 80, a further ice composite body in the form of a floating bridge carrying a roadway surface 81 for vehicles 82. The body 80 has an internal ice core 83 (FIG. 13), first armour layer 84, an insulating layer of air 85, and a second armour layer 86 held apart from the first armour layer 84 by spacers 87. The roadway surface 81 is protected from the wind and waves 92 by a pair of barriers 88.

The body 80 is moored by a series of mooring cables 89 (see FIG. 12) and is mounted on legs 90 (FIG. 13) extending into the seafloor 91. Legs 90 can be rigid or flexible, and they can also be provided with sensors and means for adjusting the degree of flexibility (analogous to active suspension systems in cars and anti-earthquake mechanisms in tall buildings).

It has been surprisingly discovered that ice composite bodies according to the invention are of a very great strength, stronger than many other state of the art materials already in use for the specialised construction purposes for which the present invention is also suitable. These ice composite bodies can in fact be designed to any desired strength up to that of the armour surface itself, since the armour distributes an applied load over a wide area of ice and the strength of the ice can be controlled by controlling its temperature. Typical strengths for the ice in water depths of up to 100 metres are 0.5–2.5 $N/mm^2$.

It has also been surprisingly found that this type of ice composite body does not change shape in the way that glaciers or soft ice deform over time, but instead is dimensionally stable, retains its form and shape more or less indefinitely and therefore can be used to construct large permanent structures efficiently.

It has also been discovered, as discussed above, that the removal of the armour and insulation at the base of a composite body enables the refrigerant conduits to freeze any natural or added water in the water bed on which the body is resting to the body of ice in the composite body. This enables strong freeze bonding and watertight sealing of the composite body to the shape and contour of any area on which it is designed to rest without the need for piles or grouting, even for base areas which are waterlogged, earthy, sandy, peaty, muddy or covered with loose stone or the like.

For floating structures the lower density of ice compared to water results in a surprisingly high level of buoyancy and surface bearing pressure at relatively low cost and buoyancy can be increased by creating voids in the ice around suitable added materials. By increasing positive buoyancy, the body can be made to float higher on the surface of a waterway or seaway and bear a greater useful load of machinery, equipment, storage units, devices, buildings or vehicles for a number of purposes.

By adding particles of matter heavier than water during construction of the ice core, the composite body acquires a specific gravity higher than water so that it can be made to gravity bond to the bottom of a waterbed or seafloor and accentuate the structural bond of the ice bonding to the area on which it is resting. A body having a density equal to that of water can be made to gravity bond to the water bed by ensuring that at least 11% of the structure is clear of the water surface.

For fixed structures the ease of matching irregular terrain, of obtaining a strong water tight seal on such terrain, of withstanding earth tremors, the increase in strength with time, the ease of repairing any damage, the absence of any environmentally damaging emissions, the ease of removal and the absence of any environmentally damaging impacts associated with removal result in a particularly suitable material for certain large fixed structures in aqueous environments, particularly in warm saline seas of moderate depth.

This invention allows the design of a structure in which the stress or pressure-bearing properties can be calculated in advance for a particular site and/or a particular shape of structure, such that the structure bears the applied load in a calculable, controlled manner, Thus, design engineers can identify the best method which can be used to construct a permanent ice structure capable of structural use anywhere in the world, as they would using traditional building materials and methods.

By way of demonstrating the usefulness of this invention, the embodiment of FIGS. 12 and 13 can be compared to a conventional roadway bridge, particularly to a long bridge. The embodiment of the present invention is safer and lower in cost. As it is not rigidly fixed to the earth it provides better protection against earthquake vibrations. This safety feature is enhanced by the energy absorbing properties of ice. The large inertia and strength makes the body better able to withstand wind and wave action.

A conventional bridge from Sicily to mainland Italy, built to carry a motorway, has been costed in an EU proposal at in excess of 2 billion ($10^9$) ECU (approximately US$2.5 billion). A bridge designed in accordance with the structure of FIGS. 12 and 13, having a width of 38 meters to carry a six lane motorway, over the same sea distance from Sicily to Italy has been costed at 300 million ECU (approximately US$375 million). This costing includes the costs of independent power generation, refrigeration equipment and piping, and includes the running costs for power generation over 15 years. Despite the relatively warm sea temperatures in the Mediterranean Sea (the calculation assumed sea temperatures of up to 30° C.), therefore, the use of an ice composite body according to the invention can provide savings of up to 85%. The operational costs would be lower in colder climates than in that of the Mediterranean.

What is claimed is:

1. An ice composite body for use in the construction of floating structures located in or on water, said body comprising an inner ice core of hard freshwater ice formed from water which has been degassed or deionised before freezing, a protective outer armour layer, means for thermally insulating the ice core and refrigeration means comprising a system of conduits for refrigerant within the body, said insulating means and refrigeration means being adapted, relative to the ambient temperature of the surrounding water, to maintain the ice core in a frozen condition, wherein the ice core is totally enclosed in said armour layer, and wherein when the structures are located in or on fresh water the ice core is maintained at a temperature of less than 0° C. less a further 0.5° C. for each 50 atmospheres of pressure experienced by the ice at its most stressed point, and when located in or on salt water the ice core is maintained at a temperature of less than −2.2° C. less a further 0.5° C. for each 50 atmospheres of pressure experienced by the ice at its most stressed point, said pressure including pressure shock waves experienced in normal use.

2. An ice composite body according to claim 1, wherein the insulating means is part of the armour layer, the degree of insulation being determined by the thickness of said armour layer and the nature of the material used for said armour layer.

3. An ice composite body according to claim 1, wherein the insulating means comprises a layer of insulating material situated intermediate the ice core and the armour layer.

4. An ice composite body according to claim 3, wherein the insulating material is selected from air, ice, trapped water, stone, earth, concrete, reinforced concrete, insulating cement, plastic foam, wood, wood dust, waste paper, sand, treated urban waste, textile fibre and mineral fibre.

5. An ice composite body according to claim 1, wherein the insulating means and the refrigeration means are adapted to maintain the ice core in a frozen condition at ambient water temperatures of greater than 5° C.

6. An ice composite body according to claim 5, wherein the insulating means and the refrigeration means are adapted to maintain the ice core in a frozen condition at ambient water temperatures of greater than 10° C.

7. An ice composite body according to claim 6, wherein the insulating means and the refrigeration means are adapted to maintain the ice core in a frozen condition at ambient water temperatures of greater than 15° C.

8. An ice composite body according to claim 1, wherein the conduits are confined to the armour layer and insulating layer, if present.

9. An ice composite body according to claim 1, wherein the conduits extend into the ice core.

10. An ice composite body according to claim 1, further comprising means for anchoring the body to the water bed.

11. An ice composite body according to claim 1, wherein the body has a positive net buoyancy.

12. An ice composite body according to claim 1, wherein the armour layer comprises a double hull.

13. An ice composite body according to claim 1, wherein the material used in the armour layer is selected from metal, stone, concrete, reinforced concrete, bitumen macadam, tile, and brick.

14. An ice composite body according to claim 1, wherein the refrigerant conduits are preformed integrally in the armour layer or insulating layer, if present.

15. An ice composite body according to claim 1, wherein the refrigerant conduits are formed separately from the armour layer and insulating layer, if present.

16. An ice composite body according to claim 15, wherein the refrigerant conduits act as internal strengthening members for the body.

17. An ice composite body according to claim 1, wherein the ice core is formed from water to which an additive has been added before or during freezing, said additive being effective to vary the density of the ice when formed.

18. An ice composite body according to claim 17, in which the additive is selected from gelatin, long chain hydrocarbons in which any substitutions are primarily hydroxyl groups and long chain polyelectrolytes having hydrogen or hydroxyl binding radicals.

19. An ice composite body according to claim 17, in which the additive is selected from metal fibre, ceramic fibre, glass fibre, mineral fibre, plastic or polymer fibre, carbon fibre, peat fibre, wood fibre, sand, gravel, stone, plastic foam particles, wood shavings, sawdust and concrete.

20. An ice composite body according to claim 17, wherein the additive is added to the water before or during freezing.

21. An ice composite body according to claim 1, wherein the ice core is formed from water to which an additive has been added before or during freezing, said additive being effective to increase the strength of the ice when formed.

22. An ice composite body according to claim 1, wherein the armour layer is formed from modular sections and ice is used as a structural material to hold said sections together.

23. A process of constructing an ice composite body according to claim 1, comprising the steps of constructing a hull of armour coating using a technique of slip forming or continuously replaced shuttering, providing the hull with a lining of insulating material and filling the interior thereof with ice which has been made from water which has been degassed or deionized before freezing.

24. A process of constructing an ice composite body according to claim 1 for use in environments where average ambient temperatures are greater than the freezing point of water, comprising the steps of constructing a hull of armour coting, providing the hull with a lining of insulating material and filling the interior of the hull with ice which has been made from water which has been degassed or deionized before freezing at a location where average ambient temperatures are less than the freezing point of water, and subsequently transporting the ice composite body to the environment in which it is to be used.

25. A process of constructing an ice composite body according to claim 1, comprising the steps of constructing a hull of armour coating, providing the hull with a lining of insulating material and filling the interior thereof with ice which has been made from water which has been degassed or deionized, wherein an additive selected from the group consisting of metal fiber, ceramic fiber, glass fiber, plastic or polymer fiber, carbon fiber, peat fiber, wood fiber, sand, gravel, stone, plastic foam particles, sawdust and concrete is added to the water before freezing.

26. An ice composite body according to claim 1, when in the form of a bridge, a breakwater, a causeway, a pontoon, an artificial island, a wave power barrage, a harbour wall, a wind power farm or an aircraft runway.

27. An ice composite body according to claim 1, wherein the top surface of the armour coating is provided with a roadway surface or a railway track.

* * * * *